US009855754B2

(12) United States Patent
Okazawa et al.

(10) Patent No.: US 9,855,754 B2
(45) Date of Patent: Jan. 2, 2018

(54) LIQUID DISCHARGING DEVICE

(71) Applicant: SEIKO EPSON CORPORATION, Tokyo (JP)

(72) Inventors: Noriaki Okazawa, Shiojiri (JP); Koji Morikoshi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/214,299

(22) Filed: Jul. 19, 2016

(65) Prior Publication Data

US 2017/0057234 A1 Mar. 2, 2017

(30) Foreign Application Priority Data

Aug. 24, 2015 (JP) ..... 2015-164514

(51) Int. Cl.
*B41J 2/175* (2006.01)

(52) U.S. Cl.
CPC ..... *B41J 2/17523* (2013.01); *B41J 2/1752* (2013.01)

(58) Field of Classification Search
CPC ..... B41J 2/17523
See application file for complete search history.

(56) References Cited

U.S. PATENT DOCUMENTS

2002/0093554 A1* 7/2002 Smith ..... B41J 2/17503 347/85
2003/0151645 A1* 8/2003 Yamada ..... B41J 2/17523 347/47
2006/0017766 A1* 1/2006 Ito ..... B41J 2/14 347/20
2007/0296774 A1* 12/2007 Lee ..... B41J 2/17523 347/85
2011/0062673 A1* 3/2011 Smith ..... B41J 2/1752 277/612
2012/0182363 A1* 7/2012 Watanabe ..... B41J 2/175 347/85
2013/0327852 A1* 12/2013 Hara ..... B41J 2/19 239/553
2014/0043402 A1* 2/2014 Hara ..... B41J 2/175 347/85
2015/0367649 A1* 12/2015 Koda ..... B41J 2/20 347/85

FOREIGN PATENT DOCUMENTS

JP 2004-122462 4/2004
JP 2007-015272 1/2007

* cited by examiner

*Primary Examiner* — Shelby Fidler
(74) *Attorney, Agent, or Firm* — Workman Nydegger

(57) ABSTRACT

A liquid discharging device includes a liquid discharging portion that discharges liquid supplied from a liquid container; a container mounting portion in which the liquid container is detachably mounted; a connection portion in which a flow path for supplying liquid within the liquid container mounted in the container mounting portion to the liquid discharging portion is formed; a sealing body that surrounds the connection portion in a plan view, and includes a contact surface in contact with the liquid container mounted in the container mounting portion; and a holding portion that suppresses movement of the sealing body by being installed to overlap the contact surface in a plan view, in which the holding portion is not in contact with the liquid container mounted in the container mounting portion.

5 Claims, 10 Drawing Sheets

LIQUID DISCHARGING DEVICE

BACKGROUND

1. Technical Field

The present invention relates to technology for discharging liquid such as ink or the like, and particularly, relates to a configuration for mounting a liquid container for storing the liquid.

2. Related Art

In the related art, various technologies for discharging the liquid such as ink or the like supplied from a liquid container that is detachably mounted have been proposed. For example, in JP-A-2004-122462, a configuration for suppressing evaporation of ink by installing a sealing rubber around a joint portion through which ink is supplied from an ink tank and fixing the ink tank to the sealing rubber is disclosed. In a state where the ink tank and the sealing rubber are fixed to each other by the ink, dropout of the sealing rubber can be generated together with the ink tank in a process for removing the ink tank. Accordingly, a configuration in which the sealing rubber is fixed by using a caulking portion is disclosed in FIG. 7 of JP-A-2004-122462.

However, it is unlikely to accurately determine the position of the ink tank in a configuration where the caulking portion for fixing the sealing rubber interferes with the ink tank.

SUMMARY

An advantage of some aspects of the invention is to accurately determine the position of a liquid container while suppressing movement of a sealing body for suppressing the evaporation of liquid.

According to an aspect of the invention, there is provided a liquid discharging device including: a liquid discharging portion that discharges liquid supplied from a liquid container; a container mounting portion in which the liquid container is detachably mounted; a connection portion in which a flow path for supplying liquid within the liquid container mounted in the container mounting portion to the liquid discharging portion is formed; a sealing body that surrounds the connection portion in a plan view, and includes a contact surface in contact with the liquid container mounted in the container mounting portion; and a holding portion that suppresses movement of the sealing body by being installed to overlap the contact surface in a plan view, in which the holding portion is not in contact with the liquid container mounted in the container mounting portion. In the above configuration, since the holding portion is installed so as to overlap the contact surface of the sealing body in a plan view, a possibility that the sealing body is moved when the liquid container is removed from the container mounting portion is suppressed. In addition, since the holding portion is not in contact (for example, interference) with the liquid container mounted in the container mounting portion, it is possible to accurately determine the position of the liquid container compared to a configuration where the liquid container is in contact with the holding portion.

However, in a configuration where a second side of an opposite side to a first side is first spaced from the container mounting portion by rotating the liquid container according to a setting of the first side of the liquid container as a supporting point in a process where the liquid container mounted in a container mounting portion is removed, there is a tendency that dropout of a portion of the second side of the sealing body is easily generated compared to a portion of the first side. In view of the above tendency, a configuration where at least the holding portion is installed in a side in which the liquid container is first spaced from the container mounting portion in a process where the liquid container mounted in the container mounting portion is removed is effective in that the movement of the sealing body is suppressed.

In accordance with a preferable aspect of the invention, the holding portion may be a portion that is upwardly projected on the contact surface by partially melting the connection portion. In the above aspect, since the portion that is upwardly projected on the contact surface by partially melting the connection portion is used as the holding portion, there is an advantage that a configuration and a manufacturing method are simplified compared to a configuration where a holding portion of a separate body from the connection portion is installed.

In accordance with a preferable aspect of the invention, the connection portion may include a first portion including an installation surface of a filter through which the liquid supplied from the liquid container to the flow path passes, and a second portion including a stepped surface that is positioned on an opposite side to the liquid container only from the installation surface, and the holding portion may be upwardly projected on the contact surface contiguous to the stepped surface. In the above aspect, for example, in an inspection process of the liquid discharging device, by positioning a tip end of a tubular body for supplement liquid in close contact with the stepped surface, it is possible to supply the liquid to the flow path of the connection portion through the tubular body.

In accordance with a preferable aspect of the invention, the holding portion may be a portion in which an end portion of a protruding portion inserted into an insertion hole of the sealing body is deformed. In the above aspect, the holding portion is realized by deformation (caulking) of the end portion of the protruding portion inserted into the insertion hole of the sealing body. Accordingly, there is an advantage that the movement (or dropout) of the sealing body can be effectively prevented by using a simple process.

In accordance with a preferable aspect of the invention, a shape of the protruding portion may be a shape along a circumferential direction of the sealing body in a plan view. In the above aspect, since the protruding portion of the shape along the circumferential direction of the sealing body in the plan view is installed, there is an advantage that the movement of the sealing body can be effectively prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
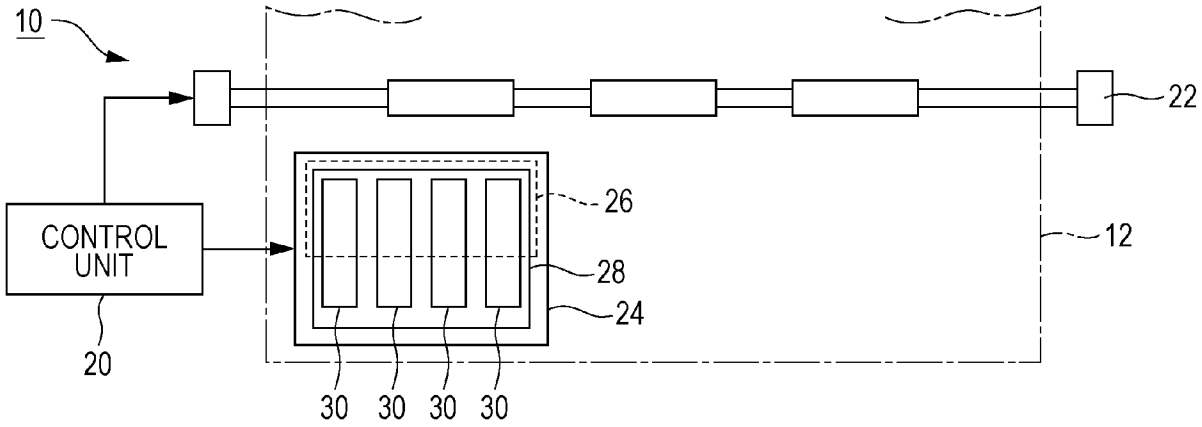
FIG. 1 is a configuration diagram of a liquid discharging device according to a first embodiment.

FIG. 1 is a configuration diagram of a liquid discharging device 10 according to a first embodiment of the invention. The liquid discharging device 10 of the first embodiment is an ink jet printing device that discharges ink that is an example of liquid on a medium 12 such as printing paper and the like. As illustrated in FIG. 1, the liquid discharging device 10 includes a control unit 20, a transport mechanism 22, a carriage 24, a liquid discharging portion 26, and a container mounting portion 28. The control unit 20 integrally controls each portion of the liquid discharging device 10. The transport mechanism 22 transports the medium 12 in a predetermined direction under the control of the control unit 20.

The liquid discharging portion 26 and the container mounting portion 28 are mounted on the carriage 24 of the first embodiment and a plurality of the liquid containers (cartridge) 30 for storing a plurality of types of ink that are different from each other are detachably supported in the container mounting portion 28. The liquid discharging portion 26 is an ink jet head that discharges the ink that is supplied from the liquid container 30 from a plurality of nozzles on the medium 12 under the control of the control unit 20. Specifically, the liquid discharging portion 26 includes a pressure chamber and a piezoelectric element corresponding to each of a plurality of nozzles, and discharges ink that is filled within the pressure chamber from each of nozzles, by changing pressure within the pressure chamber by driving each of the piezoelectric elements through supplementing of a drive signal according to image data. However, it is also possible to use the liquid discharging portion 26 of a heat method using heat generation elements for changing pressure within the pressure chamber by generating a bubble within the pressure chamber by heating. The control unit 20 reciprocates the carriage 24 in a direction intersecting the direction in which the medium 12 is transported. The liquid discharging portion 26 discharges the ink on the medium 12 in parallel with the transportation of the medium 12 and the repetitive reciprocation of the carriage 24 by the transport mechanism 22 such that a desired image is formed on a surface of the medium 12.

Figure 2:
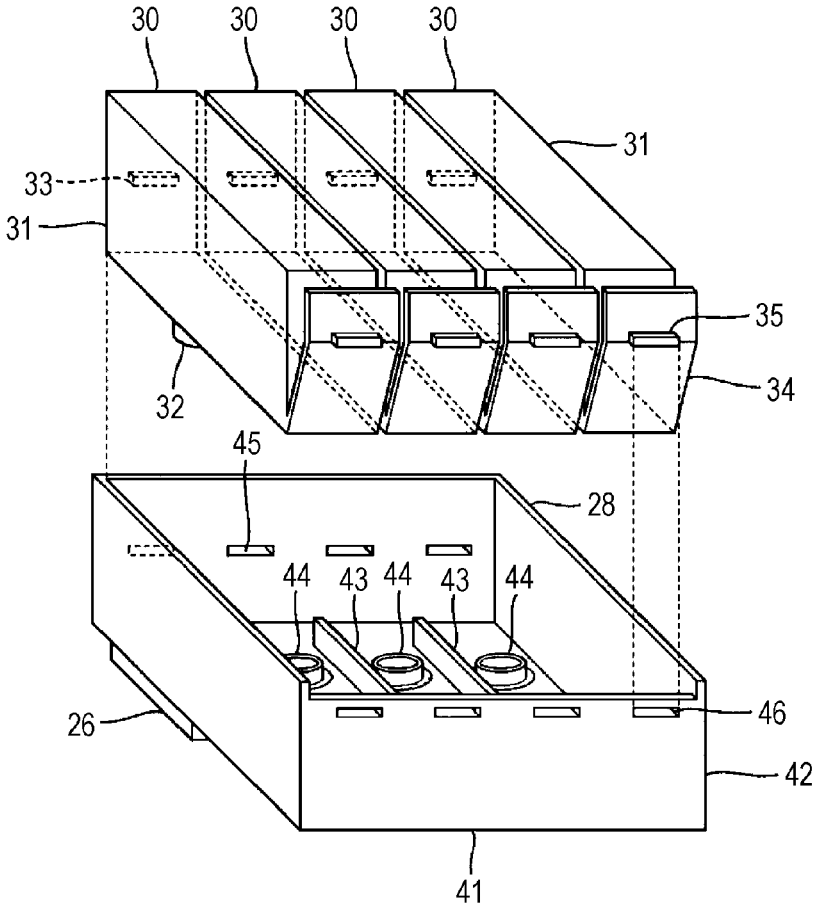
FIG. 2 is a perspective view of a container mounting portion and a liquid container.

FIG. 2 is a perspective view of the liquid container 30 and the container mounting portion 28. As illustrated in FIG. 2, any one of the liquid containers 30 includes a main body portion 31, a supply port 32, a claw portion 33, and a flexible portion 34. The main body portion 31 is a hollow housing of a substantially rectangular shape for accommodating the ink. The supply port 32 is a cylindrical path for supplying the ink within the liquid discharging portion 26 by installing the path on a lower surface of the main body portion 31. The claw portion 33 is protruded from a side surface (back surface) of the main body portion 31. The flexible portion 34 is a portion in which a base end portion thereof is connected to the main body portion 31 and an elastically deformable portion by pressing a tip portion by a user. A claw portion 35 is formed on the flexible portion 34.

The container mounting portion 28 is a hollow housing of a substantially rectangular shape of which an upper portion is opened, and includes a bottom portion 41 and a side portion 42. The bottom portion 41 is a portion of a flat plate shape constituting a bottom surface of the container mounting portion 28, and the side portion 42 is a portion that is protruded from a surface of the bottom portion 41 along the peripheral of the bottom portion 41. A partition plate 43 for partitioning a space for accommodating the liquid container 30 and a connection portion 44 connected to the supply port 32 of the liquid container 30 mounted in the container mounting portion 28 are formed in the bottom portion 41. On the other hand, an engaging portion 45 and an engaging portion 46 are formed in each of the liquid containers 30 on the side portion 42. The engaging portion 45 and the engaging portion 46 are notches or openings. The claw portion 33 of the liquid container 30 is engaged with the engaging portion 45 and the claw portion 35 thereof is engaged with the engaging portion 46 such that the liquid container 30 is held in a state where the supply port 32 is connected to the connection portion 44 of the bottom portion 41.

Figure 3:
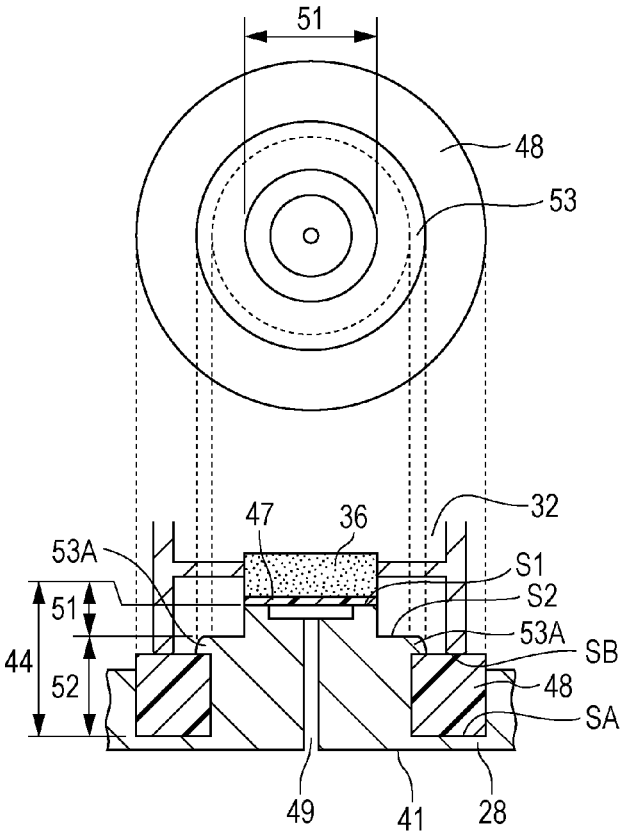
FIG. 3 is a plan view and a sectional view of a connection portion.

FIG. 3 is an enlarged plan view and an enlarged sectional view of the vicinity of any one of the connection portion 44 among the container mounting portions 28. The supply port 32 of the liquid container 30 is conveniently specified in the sectional view. As illustrated in FIG. 3, a base surface SA is formed on a surface (upper surface) of the bottom portion 41 of the container mounting portion 28. The base surface SA is a lower plane compared to a surface of the bottom portion 41. The connection portion 44 and a sealing body 48 are installed on the base surface SA. The connection portion 44 is protruded from the base surface SA. For example, in the first embodiment, it is assumed that a case where the connection portion 44 is integrally formed with the container mounting portion 28 by injection molding of resin material such as polypropylene (PP) or the like. However, it is also possible to fix a connection portion 44 different from the container mounting portion 28 on the base surface SA.

The sealing body 48 is an annular sealing member formed of elastic material such as rubber, elastomer, and the like, and is disposed on the base surface SA so as to surround the connection portion 44 in a plan view. In FIG. 3, the sealing body 48 of an annular sealing member is exemplified in a plan view. However, a shape of the sealing body 48 is arbitrary. For example, it is possible to install the sealing body 48 of an oval outline in a plan view.

As illustrated in FIG. 3, the sealing body 48 includes a contact surface SB. The contact surface SB is a flat surface opposite to the base surface SA. In a state where the liquid container 30 is mounted in the container mounting portion 28, a tip end of the supply port 32 of the liquid container 30 is in contact with the contact surface SB of the sealing body 48 such that an inner space of the supply port 32 is sealed. Therefore, it is possible to suppress the evaporation (or leakage) of the ink supplied from the supply port 32 to the connection portion 44. As described above, the sealing body 48 functions as a sealing member for sealing a portion in which the supply port 32 and the connection portion 44 are connected. On the other hand, by fixing and solidifying the ink between the tip end of the supply port 32 of the liquid container 30 and the contact surface SB of the sealing body 48, there is a case where the supply port 32 and the contact surface SB are stuck to each other.

As illustrated in FIG. 3, the connection portion 44 includes a first portion 51 and a second portion 52. The second portion 52 is a portion protruded from the base surface SA, and the first portion 51 is a portion positioned on an opposite side to the base surface SA by pinching the second portion 52. A flow path 49 over the first portion 51 and the second portion 52 is formed in an inner side of the connection portion 44. The flow path 49 is a pipe line for supplying the ink within the liquid container 30 mounted in the container mounting portion 28 to the liquid discharging portion 26. As illustrated in FIG. 3, the sealing body 48 surrounds the second portion 52. That is, an inner periphery surface of the sealing body 48 and an outer periphery surface of the second portion 52 are opposed or fixed to each other.

A filter 47 is installed on a surface (hereinafter, referred to as "installation surface") S1 of the opposite side of the second portion 52 in the first portion 51. For example, the filter 47 is fixed on an installation surface S1 by thermo-compression. On the other hand, a supply body 36 is installed in an inner portion of the supply port 32 of the liquid container 30. The supply body 36 is formed by porous material or a nonwoven fabric to which the ink within the liquid container 30 penetrates. In a state where the liquid container 30 is mounted in the container mounting portion 28, the supply body 36 is pressed against a surface of the filter 47, and the ink penetrated from the main body portion 31 of the liquid container 30 to the supply body 36 is passed through the filter 47 and supplied to the flow path 49. The filter 47 collects foreign matter and bubbles that are mixed with the ink supplied from the liquid container 30 to the flow path 49 of the connection portion 44.

As illustrated in FIG. 3, an outer dimension in a plan view of the second portion 52 is large compared to the first portion 51. Therefore, the second portion 52 includes a surface (hereinafter, referred to as "stepped surface") S2 projected from an outer peripheral surface in the first portion 51 in a plan view. The stepped surface S2 is a plane that forms a lower step compared to the installation surface S1 of the first portion 51 and a higher step compared to the base surface SA. That is, the stepped surface S2 is positioned on the opposite side of the liquid container 30 from the installation surface S1

As illustrated in FIG. 3, a holding portion 53A is installed in the second portion 52 of the first embodiment. The holding portion 53A is an eaves shape portion upwardly projected on the contact surface SB of the sealing body 48 by being formed to be continuous along the stepped surface S2, and is formed as an annular shape protruded from an outer peripheral surface over the entire circumference of the second portion 52. Therefore, the holding portion 53A is overlapped with the contact surface SB of the sealing body 48 in a plan view. That is, the holding portion 53A is opposed to the base surface SA and in contact with the contact surface SB by pinching the sealing body 48. As described above, movement (or dropout) of the sealing body 48 is suppressed by pinching the sealing body 48 between the base surface SA and the holding portion 53A. That is, the holding portion 53A of the first embodiment holds the sealing body 48 so as to suppress the movement of the sealing body 48.

As can be appreciated from FIG. 3, the supply port 32 and the holding portion 53A of the liquid container 30 are not overlapped in a plan view. Specifically, an inner peripheral surface of the supply port 32 spaced from an outer peripheral edge of the holding portion 53A is positioned in an outer region of the holding portion 53A in a plan view. That is, the holding portion 53A is not in contact with the liquid container 30 (particularly, supply port 32) mounted in the container mounting portion 28.

Figure 4:
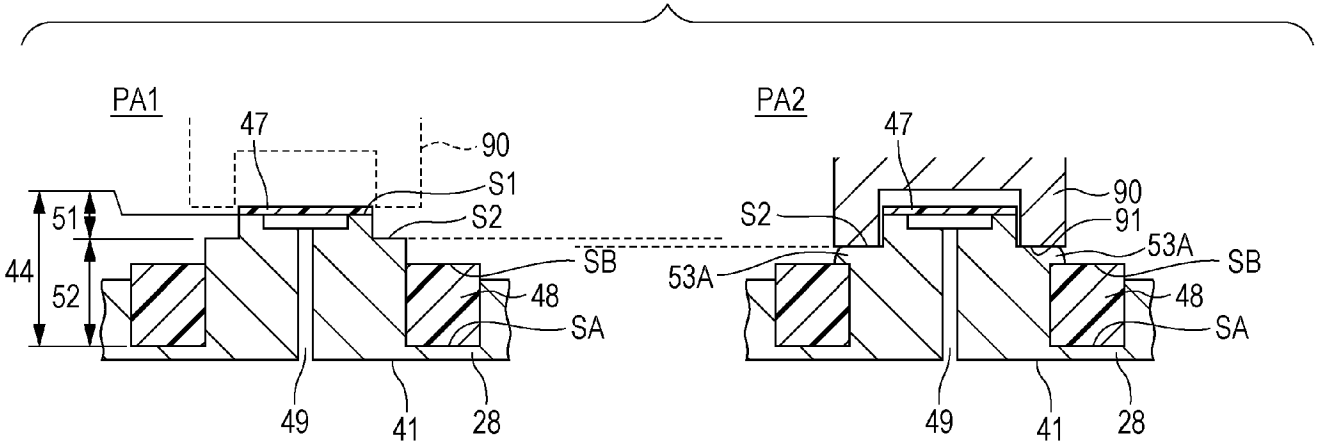
FIG. 4 is an explanatory view of a manufacturing process of the connection portion.

FIG. 4 is an explanatory view of a process for forming the holding portion 53A of the first embodiment. In the process PA1 of FIG. 4, the container mounting portion 28 in which the connection portion 44 including the first portion 51 and the second portion 52 is formed is provided, and the sealing body 48 is disposed on the base surface SA so as to surround the second portion 52.

In a process PA2 after the process PA1 is performed, the stepped surface S2 of the second portion 52 is pressed on a machining surface 91 of a machining device 90. The machining surface 91 is heated at a temperature to melt the connection portion 44. Therefore, a portion melted by the heating on the machining surface 91 of the second portion 52 flows above the contact surface SB. By cooling the connection portion 44 after the performance of the process PA2, the holding portion 53A of a shape upwardly projected on the contact surface SB of the sealing body 48 is integrally formed with the connection portion 44. As can be understood from the above description, the holding portion 53A of the first embodiment is a portion upwardly projected on the contact surface SB by partially melting the connection portion 44.

In a state where the supply port 32 of the liquid container 30 and the contact surface SB of the sealing body 48 are fixed to each other by the adhesion of ink, external force toward a movement direction of the liquid container 30 can act on the sealing body 48 in the process for removing the liquid container 30 by a user. In the first embodiment, since the holding portion 53A is installed so as to overlap the holding portion 53A with the contact surface SB of the sealing body 48 in a plan view, it is possible to reduce a possibility of the movement of the sealing body 48 in the process for removing the liquid container 30. Moreover, in the first embodiment, since the holding portion 53A is not in contact (for example, interference) with the liquid container 30 mounted in the container mounting portion 28, it is possible to accurately determine the position of the liquid container 30 compared to a configuration in which the liquid container 30 is in contact with the holding portion 53A.

As a method for fixing the sealing body 48 in the bottom portion 41, it is also assumed that adhesion using adhesive and pressing (strong fit) of the sealing body 48 is used. However, in a configuration in which the sealing body 48 is fixed by adhesive, there is a possibility that the adhesive is deteriorated and peeled by the adhesion and reaction of the ink with respect to the adhesive. In addition, in a configuration in which the sealing body 48 is pressed, a situation of replacement of the sealing body 48 can be difficult according to the temporal plastic deformation (creep). According to the first embodiment, since the sealing body 48 is held by the holding portion 53A, it is possible to suppress the peeling of the adhesive and the deformation of the sealing body 48. It is also possible to use the adhesion and the pressure in holding by the holding portion 53A.

In addition, in the first embodiment, since the holding portion 53A is formed by partially melting the connection portion 44, there is an advantage that a structure for mounting the liquid container 30 is simplified (for example, number of components are reduced), compared to a configuration in which a holding portion different from the connection portion 44 is installed on the connection portion 44.

However, before the shipment of the liquid discharging device 10, inspection (hereinafter, referred to as "filling inspection") for determining the quality of an individual by actually supplying the ink to the liquid discharging portion 26, is performed. As described above, the flow velocity of the ink supplied to the liquid discharging portion 26 through the supply body 36 of the liquid container 30 is very low, and a long time is required to supply sufficient ink to the liquid discharging portion 26. Therefore, the supplement of the ink through the supply body 36 is not necessarily appropriate at the stage of the filling inspection in which rapid work is required.

Figure 5:
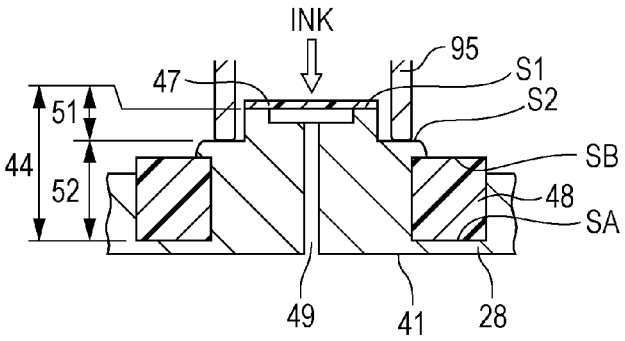
FIG. 5 is an explanatory view of filing inspection.

In view of the above circumstances, in the first embodiment, the connection portion 44 is formed in the first portion 51 including the installation surface S1 and the second portion 52 including the stepped surface S2 that forms a step with respect to the installation surface S1. According to the configuration, it is possible to appropriately use the stepped surface S2 of the second portion 52 of the connection portion 44 in the filling inspection so as to supply the ink to the liquid discharging portion 26. Specifically, as illustrated in FIG. 5, in a state where a tip end of a tubular body 95 for supplement is in close contact with the stepped surface S2 of the second portion 52, the ink is supplied to the liquid discharging portion 26 through the tubular body 95. Since the supplement of the ink through the tubular body 95 compared to the supplement through the supply body 36 of the liquid container 30 is fast, it is possible to effectively perform the filling inspection. As understood from the above description, the stepped surface S2 of the second portion 52 of the connection portion 44 is used in the supplement of the ink in the filling inspection.

Second Embodiment

A second embodiment of the invention will be described. A detailed description with respect to elements having the same effects or functions in each embodiment exemplified below as that of the first embodiment will be appropriately omitted by using numerals used in the description of the first embodiment.

Figure 6:
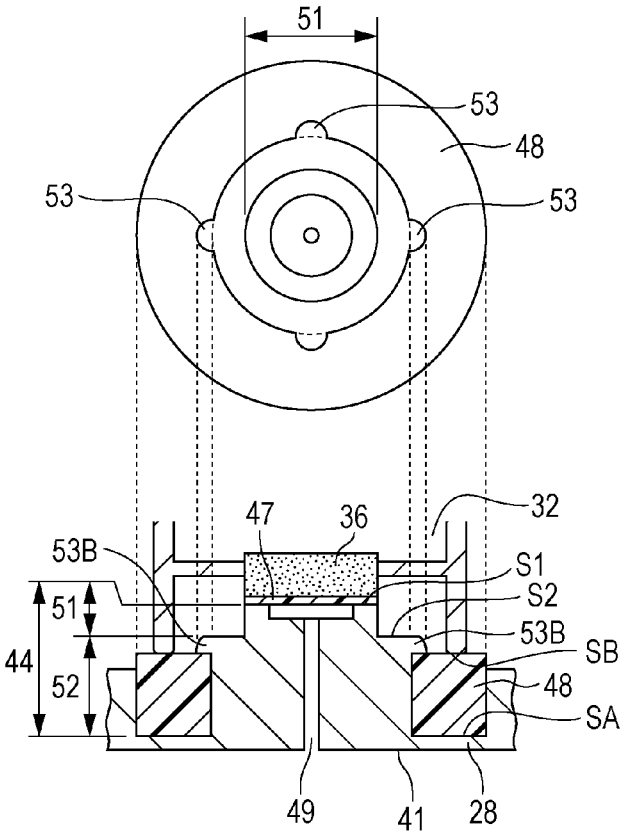
FIG. 6 is a plan view and a sectional view of a connection portion in a second embodiment.

FIG. 6 is a plan view and a sectional view of the connection portion 44 in the second embodiment. In the first embodiment, the holding portion 53A of an annular shape protruded from an outer peripheral surface over the entire circumference of the second portion 52 is exemplified. As illustrated in FIG. 6, in the connection portion 44 of the second embodiment, a plurality of holding portions 53B are installed at positions different from the circumferential direction of the second portion 52. Each of the plurality of the holding portions 53B is a portion upwardly projected on the contact surface SB of the sealing body 48, by being formed on an outer peripheral surface of the second portion 52 so as to be continuous on the stepped surface S2. Specifically, each of the holding portions 53B is opposed to the base surface SA by pinching the sealing body 48, and in contact with the contact surface SB. That is, by pinching the sealing body 48 between the base surface SA and each of the holding portions 53B, the movement of the sealing body 48 is suppressed similar to the first embodiment. The plurality of the holding portions 53B are not in contact with the supply port 32 of the liquid container 30 mounted in the container mounting portion 28.

Figure 7:
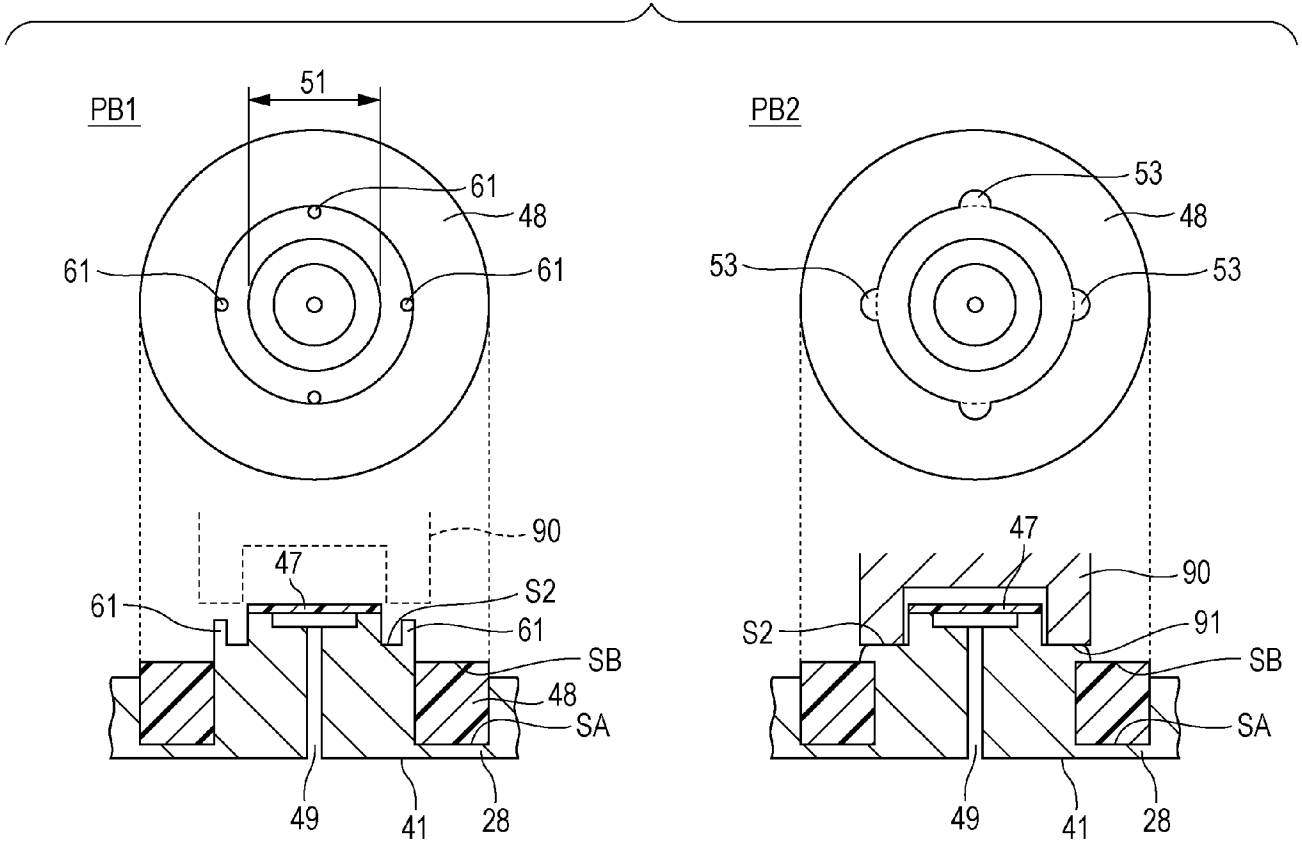
FIG. 7 is an explanatory view of a manufacturing process of the connection portion in the second embodiment.

FIG. 7 is an explanatory view of a process for forming the holding portion 53B of the second embodiment. In the process PB1 of FIG. 7, the container mounting portion 28 in which a plurality of columnar bodies 61 are formed on the second portion 52 is provided. Each of columnar bodies 61 is a pin shape structural body protruded from the stepped surface S2 of the second portion 52. Similar to the first embodiment, the sealing body 48 is disposed on the base surface SA so as to surround the second portion 52.

In process PB2 after performing the process PB1, the plurality of columnar bodies 61 are pressed on the machining surface 91 of the machining device 90 that is heated at a high temperature. Each columnar body 61 that is melted through the heating by the machining surface 91 flows above the contact surface SB of the sealing body 48 such that the holding portion 53B is formed. That is, the holding portion 53B of the second embodiment is a portion upwardly projected on the contact surface SB by partially melting the connection portion 44, similar to the holding portion 53A of the first embodiment. Even in the second embodiment, the same effect as the first embodiment is realized.

Third Embodiment

Figure 8:
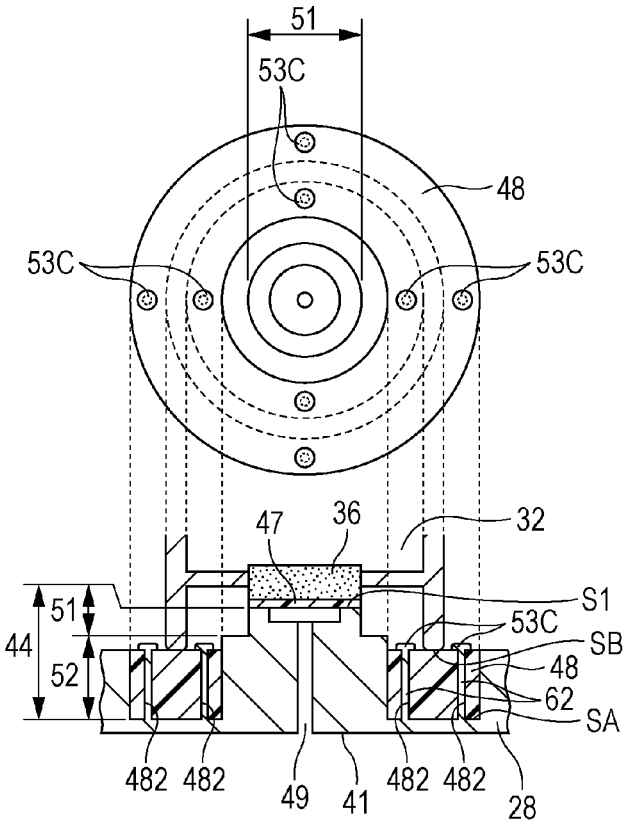
FIG. 8 is a plan view and a sectional view of a connection portion in a third embodiment.

FIG. 8 is a plan view and a sectional view in the vicinity of one connection portion 44 in a third embodiment. As illustrated in FIG. 8, in the third embodiment, a plurality of protruding portions 62 are used to hold the sealing body 48. The plurality of protruding portions 62 are a structural body of a pin shape protruded appropriately perpendicular to the base surface SA of the container mounting portion 28. On the other hand, an insertion hole 482 to which each of the protruding portions 62 is inserted is formed in the sealing body 48. The sealing body 48 is held by a holding portion 53C deformed from a tip end portion projected from the contact surface SB among the protruding portions 62 inserted to the insertion hole 482 of the sealing body 48. The holding portion 53C of the third embodiment is an eaves shape portion upwardly projected on the contact surface SB of the sealing body 48. Similar to the holding portion 53A of the first embodiment and the holding portion 53B of the second embodiment, the movement of the sealing body 48 is suppressed by pinching the sealing body 48 between the base surface SA and the holding portion 53C. As is understood from the above description, the protruding portion 62 of the third embodiment is a caulking pin for holding the sealing body 48 by caulking (typically thermal caulking).

As is understood from FIG. 8, in the third embodiment, the plurality of holding portions 53C are formed at positions different from a circumferential direction of the connection portion 44 and a plurality of (two) the holding portions 53C are formed at positions mutually spaced in a radial direction of the connection portion 44. The supply port 32 of the liquid container 30 mounted in the container mounting portion 28 is in contact with a region between two holding portions 53C that are adjacent to each other in a radial direction of the connection portion 44 among the contact surface SB of the sealing body 48. Therefore, the plurality of the holding portions 53C are not in contact with the supply port 32 of the liquid container 30 mounted in the container mounting portion 28.

Figure 9:
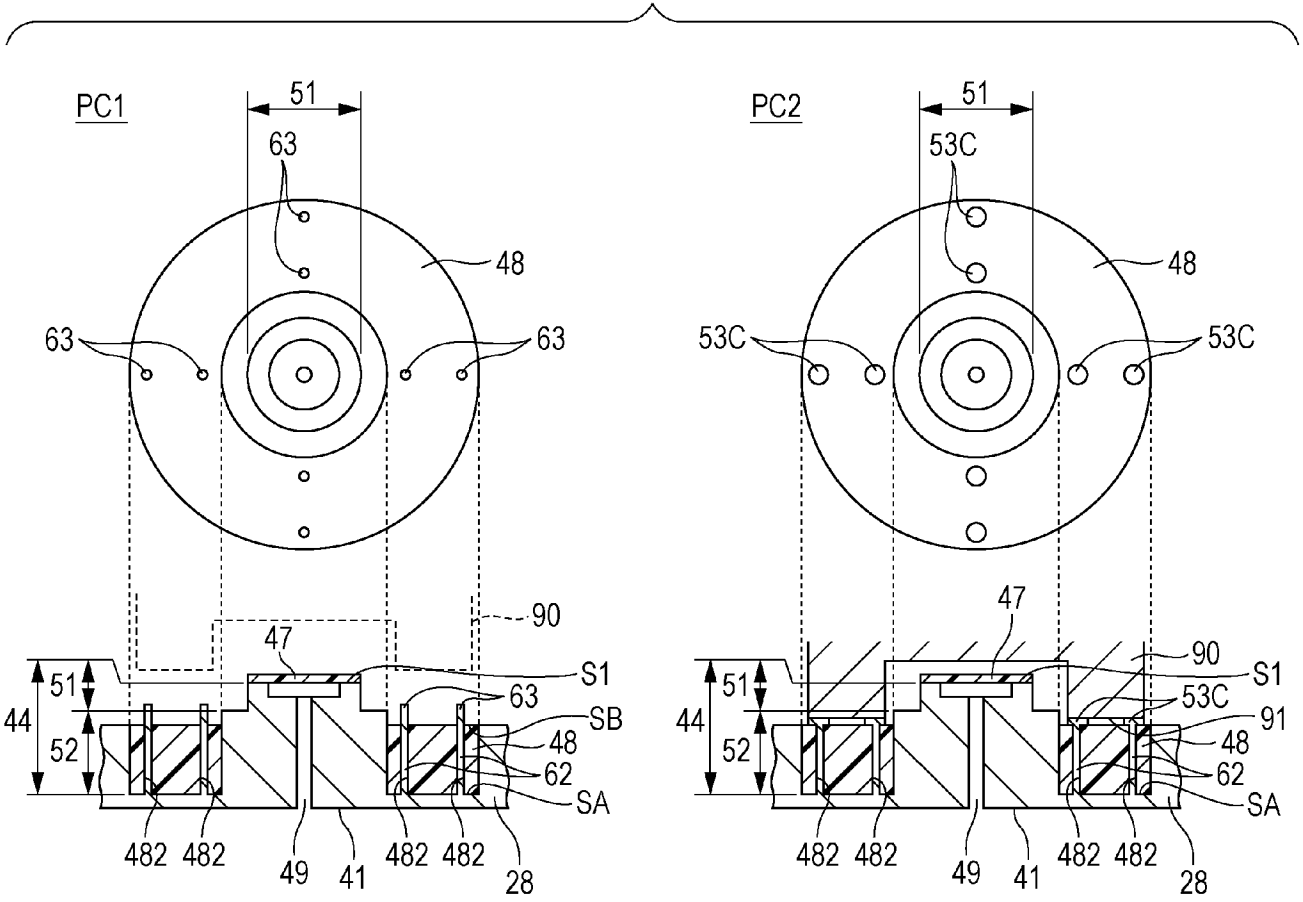
FIG. 9 is an explanatory view of a manufacturing process of the connection portion of the third embodiment.

FIG. 9 is an explanatory view of a process for forming the holding portion 53C of the third embodiment. In the process PC1 of FIG. 9, the container mounting portion 28 in which a plurality of columnar bodies 63 are formed on the installation surface S1 is provided, and the sealing body 48 is disposed on the base surface SA in a state where the columnar bodies 63 are inserted to each insertion hole 482 of the sealing body 48. In the process PC2 after performing the process PC1, the protruding portion 62 including the holding portion 53C projected to the contact surface SB is formed by deforming (that is, thermal caulking) a tip end portion protruded from the contact surface SB of the sealing body 48 among the columnar bodies 63 through the heating and pressing by the machining surface 91 of the machining device 90.

Even in the third embodiment, the same effect as the first embodiment is realized. In addition, in the third embodiment, since the holding portion 53C is formed by deformation (caulking) of a tip end portion of the protruding portion 62, there is an advantage that the movement (or dropout) of the sealing body 48 can be effectively prevented by using a simple process.

Fourth Embodiment

Figure 10:
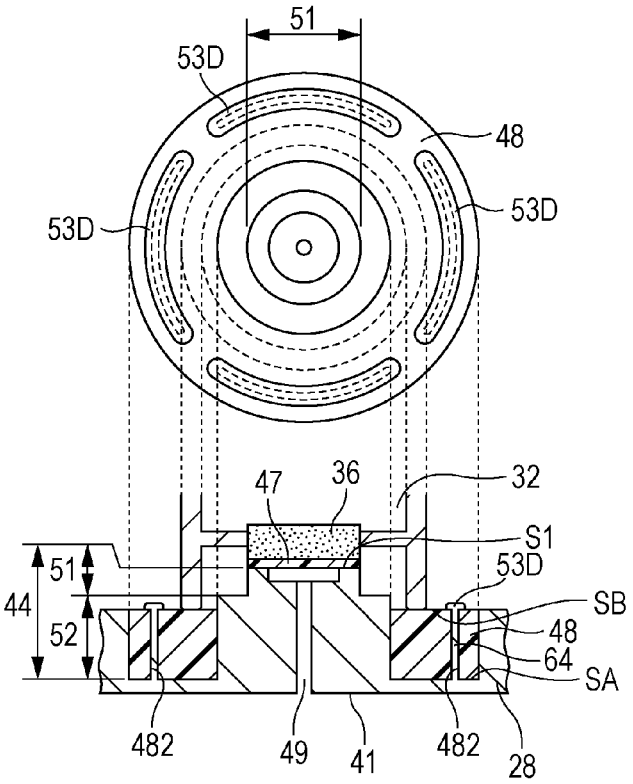
FIG. 10 is a plan view and a sectional view of a connection portion in a fourth embodiment.

FIG. 10 is a plan view and a sectional view in the vicinity of one connection portion 44 in the fourth embodiment. As understood from FIG. 10, in the fourth embodiment, similar to the third embodiment, the sealing body 48 is held by a plurality of protruding portions 64 protruded from the base surface SA. However, while the protruding portion 62 of the third embodiment is a columnar shape, the protruding portion 64 of the fourth embodiment is formed in a wall shape along the circumferential direction of the sealing body 48 in a plan view. Similar to the protruding portion 62 of the third embodiment, the sealing body 48 is held by a holding portion 53D deformed from a tip end portion of an opposite side to the base surface SA among the protruding portion 64. The same method as the third embodiment is used in the formation of the holding portion 53D of the fourth embodiment.

Even in the fourth embodiment, the same effect as the third embodiment is realized. In addition, in the fourth embodiment, since the protruding portion 64 of a shape along the circumferential direction of the sealing body 48 in a plan view is formed, there is an advantage that the sealing body 48 can be firmly held.

Modification Example

Each embodiment exemplified above may be variously modified. Specific embodiments of deformation will be exemplified below. Two or more embodiments arbitrarily selected from the following example may be appropriately combined to the extent of not being inconsistent with each other.

Figure 11:
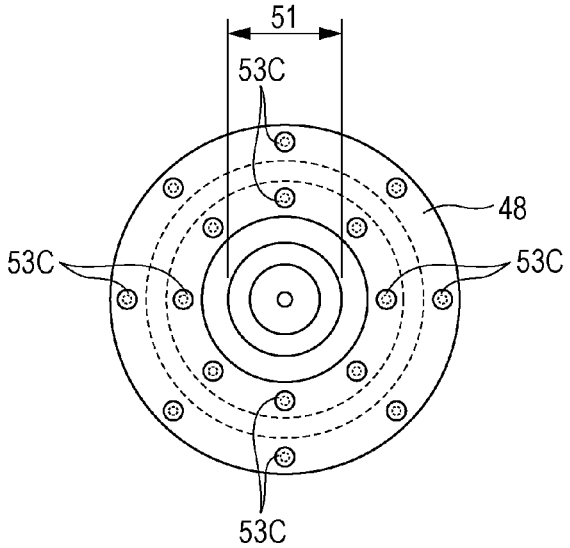
FIG. 11 is a plan view of a connection portion in a modification example.

(1) The position and number of the holding portions 53 (53A, 53B, 53C, and 53D) are arbitrary and are not limited to examples of each embodiment described above. For example, in the third embodiment, the holding portions 53C (protruding portion 62) are installed at four locations in the circumferential direction of the connection portion 44. However, as illustrated in FIG. 11, it is also possible to install the holding portions 53C at eight locations of the circumferential direction of the connection portion 44.

Figure 12:
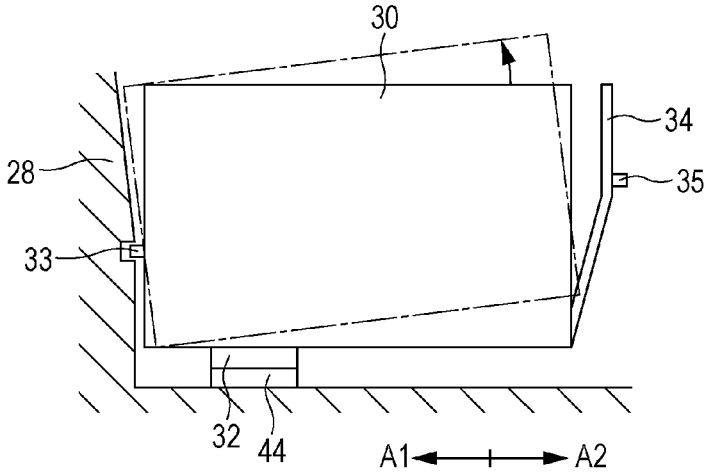
FIG. 12 is an explanatory view of a process for removing a liquid container.

A process for removing the liquid container 30 from the container mounting portion 28 is exemplified in FIG. 12. As illustrated in FIG. 12, by removing the claw portion 35 of the liquid container 30 from the engaging portion 46, and by rotating the other side (hereinafter, referred to as "A2 side") of the liquid container 30 by setting, as a supporting point, the claw portion 33 of one side (hereinafter, referred to as "A1 side") among the liquid containers 30, the liquid container 30 is removed from the container mounting portion 28. As described above, in a configuration where a portion of the A2 side among the supply ports 32 of the liquid container 30 is separated first from the sealing body 48, there is a tendency that a portion of the A2 side among the sealing body 48 is easily moved with the liquid container 30 compared to a portion of the A1 side. In view of the above tendency, among the connection portions 44, in a process for removing the liquid container 30, a configuration in which at least the holding portion 53 is installed in the A2 side where the liquid container 30 is spaced first from the container mounting portion 28 is particularly effective in view of suppressing the movement (or dropout) of the sealing body 48.

Figure 13:
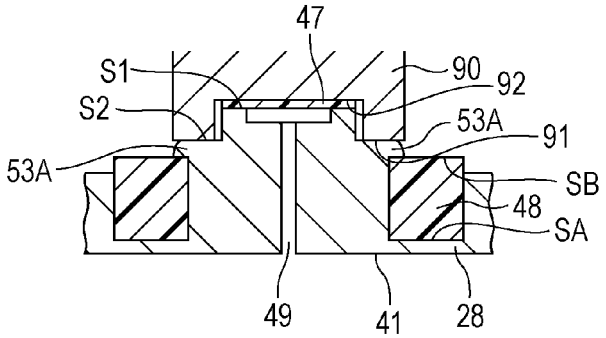
FIG. 13 is an explanatory view of a manufacturing process of a connection portion according to a modification example.

(2) In each of the embodiments described above, the filter 47 is fixed on the installation surface S1 of the connection portion 44 before performing the processes (PA2, PB2, and PC2) for forming the holding portion 53. However, it is also possible to realize the formation of the holding portion 53 and the installation of the filter 47 in the same process. For example, as illustrated in FIG. 13, the machining surface 91 of the machining device 90 is in contact with the stepped surface S2 of the second portion 52 of the connection portion 44, and a machined surface 92 of the machining device 90 is in contact with a surface of the filter 47 mounted on the installation surface S1. In the above state, by pressing in parallel the stepped surface S2 and a surface of the filter 47 in a single machining device 90, it is possible to realize the formation of the holding portion 53A and the fixation of the filter 47 in a common process. In FIG. 13, the configuration (holding portion 53A) of the first embodiment is appropriately exemplified. However, similar to configurations from the second embodiment to the fourth embodiment, it is possible to fix the filter 47 on the installation surface S1 in the same process as the formation of the holding portion 53.

(3) In each of embodiments described above, a configuration in which the liquid container 30 is mounted in the container mounting portion 28 mounted in the carriage 24 is conveniently focused. However, even in a configuration (so-called off carriage) in which the liquid container 30 is mounted in a housing (except carriage 24) of the liquid discharging device 10, it is possible to adopt the same configuration as each of the embodiments described above in connection of the liquid container 30 and the connection portion 44. In addition, in each of the embodiments described above, a serial type liquid discharging device 10 in which the carriage 24 on which the liquid discharging portion 26 is mounted is moved is exemplified. However, the invention can also be applied to a line type liquid discharging device in which a plurality of nozzles are distributed over a width direction of the medium 12.

(4) The liquid discharging device 10 exemplified in the above embodiments can be adopted in various devices such as a facsimile machine, a copy machine, and the like in addition to a device dedicated to printing. However, the use of the liquid discharging device of the invention is not limited to printing. For example, the liquid discharging device that discharges color material solution is used as a manufacturing device for forming a color filter of a liquid crystal display device. In addition, the liquid discharging device that discharges a solution of conductive material is used as a manufacturing device that forms the wiring and the electrode of the wiring board.

The entire disclosure of Japanese Patent Application No. 2015-164514, filed Aug. 24, 2015 is expressly incorporated by reference herein.

What is claimed is:

1. A liquid discharging device comprising:

a liquid discharging portion that discharges liquid supplied from a liquid container;

a container mounting portion in which the liquid container is detachably mounted;

a connection portion in which a flow path for supplying liquid within the liquid container mounted in the container mounting portion to the liquid discharging portion is formed;

a sealing body that surrounds the connection portion in a plan view, and includes a contact surface in contact with the liquid container mounted in the container mounting portion; and a holding portion that suppresses movement of the sealing body by being installed to overlap the contact surface in a plan view, wherein the holding portion is not in contact with the liquid container mounted in the container mounting portion and wherein the holding portion is a portion that is upwardly projected on the contact surface by partially melting the connection portion.

2. The liquid discharging device according to claim 1, wherein the holding portion is at least installed in a side where the liquid container is first spaced from the sealing body when the liquid container mounted in the container mounting portion is removed.

3. The liquid discharging device according to claim 1, wherein the connection portion includes a first portion including an installation surface of a filter through which the liquid supplied from the liquid container to the flow path passes, and a second portion including a stepped surface that is positioned in an opposite side to the liquid container only from the installation surface, and wherein the holding portion is upwardly projected on the contact surface contiguous to the stepped surface.

4. The liquid discharging device according to claim 1, wherein the holding portion is a portion in which an end portion of a protruding portion inserted into an insertion hole of the sealing body is deformed.

5. The liquid discharging device according to claim 4, wherein a shape of the protruding portion is a shape along a circumferential direction of the sealing body in a plan view.

* * * * *